United States Patent [19]

Nolin

[11] 4,276,760

[45] Jul. 7, 1981

[54] TWO-BOLT LOCKSET WITH SIMULTANEOUS LOCKING AND UNLOCKING OF ITS BOLTS

[76] Inventor: Roger J. Nolin, 1838 Whitehurst Dr., Monterey Park, Calif. 91754

[21] Appl. No.: 86,945

[22] Filed: Oct. 22, 1979

[51] Int. Cl.[3] ..... E05B 59/02

[52] U.S. Cl. ..... 70/107; 70/92; 70/110; 292/21; 292/DIG. 65

[58] Field of Search ..... 70/110, 107, 92, 108, 70/465; 292/21, 34, 33, 92, DIG. 65

[56] References Cited

U.S. PATENT DOCUMENTS

| | | | |
|---|---|---|---|
| 3,390,558 | 7/1968 | Tornoe et al. | 70/107 |
| 3,910,613 | 10/1975 | Nolin | 70/107 X |
| 3,999,789 | 12/1976 | Maurits et al. | 70/107 X |
| 4,183,563 | 1/1980 | Stevens | 70/107 X |

*Primary Examiner*—William E. Lyddane

*Attorney, Agent, or Firm*—Christie, Parker & Hale

[57] ABSTRACT

A two-bolt lockset simultaneously locks and unlocks in response to a single action by an operator, such as a key and cylinder. A deadbolt couples to such an operator to project and lock or retract and unlock. A crank also responds to the locking of the deadbolt to move a slide that engages and locks an actuator of the second bolt, a latch bolt, to lock the latch bolt. The slide is biased away from the latch bolt so that upon retraction of the deadbolt and corresponding motion of the crank, the slide is freed of the crank and moves out of engagement with the actuator. Preferably, the slide is carried by a retractor so that both locks clear by the single turn of a single inside operator. The retractor responds to a retractor cam attached to the inside operator to translate. The slide moves out of engagement with the actuator upon such movement and forces the crank to withdraw the deadbolt.

30 Claims, 7 Drawing Figures

36
2
94
10
98
76
121
120
150
37
35
116
32
34
122
112
114
132
14
30
125
128
126
130
110
146
152
148
45
15
46
10
12
60
40
60
38
70
72
20
22
136
18
16
28
39
26
107
24
134
3
3
86
84
74
139
138
140
156
158
100
96
2

TWO-BOLT LOCKSET WITH SIMULTANEOUS LOCKING AND UNLOCKING OF ITS BOLTS

BACKGROUND OF THE INVENTION

The present invention relates to locksets in general, and more in particular to double bolt locksets.

Locksets for the security of habitated and other space have taken a variety of forms. One form provides a key in a knob. This type of lockset is extremely convenient. It has a spring latch bolt biased to an extended position so that upon closing a door, the door stays shut without more. The latch bolt can be locked to lock the door. However, the security of the lockset is low. The projection of the latch bolt is short and therefore springing the door or door jamb to release the latch is a distinct possibility. This lockset also suffers because it breaks easily. For example, the knob can be pried off with a tube, exposing the latch to easy retraction.

A second type of lock is a mortise lock. These locks are considerably less vulnerable and are of much stronger construction than key-in-the-knob locks, but they too have fallen into disfavor in recent years. A mortise lock requires a large cutout space in the door to receive a large lock case that contains the lock mechanisms. The space weakens the door. A good swift kick near the lock can often split the door and permit entry. Mortise locks are also expensive to install and to make.

A third type of lock is the deadbolt lock. A deadbolt may be extended and retracted with a key from the outside, and the likes of a thumb turn from the inside. If this lock is well constructed, it can offer the best security of any of the locks discussed here. The deadbolt lock does not require the large cutout space that a mortise lock requires and can provide a bolt that projects substantially for cooperation with a deep hole associated with the door jamb. The difficulty with deadbolts is that they require the use of a spring latch bolt to retain the door closed when the deadbolt is retracted and the door is unlocked.

Notwithstanding this defect in deadbolts, in recent years it has been the trend to construct locksets by combining both a deadbolt and a spring latch bolt. Some of these constructions have the deadbolt only locking. Others lock both the deadbolt and the latch bolt. Clearly, when a latch bolt locks, it is necessary to provide some mechanism for this purpose, such as a cylinder, pusher turn button, or the like.

Obviously, there is substantial inconvenience in a double locking lockset in having to independently unlock both the latch bolt and a deadbolt. Some constructions employing both a deadbolt and a latch bolt simultaneously retract both the deadbbolt and the latch bolt by actuation of a single inside operator, such as an inside knob.

U.S. Pat. No. 3,910,613 to Roger Nolin describes an elegantly simple lock that permits the simultaneous opening of a spring latch and deadbolt in a surface-mounted lockset. But the patent does not describe a simultaneously locking and unlocking latch bolt and deadbolt.

Simultaneous locking and unlocking locksets have been found in mortise-type locks, such as shown in U.S. Pat. No. 3,337,248 to Fred J. Russell and Roger J. Nolin. In mortise-type locks all the components, the deadbolt mechanisms, latch bolt mechanisms, key mechanisms, and retracting mechanisms, are located in the same case in close proximity to each other. Accordingly, it is comparatively easy to arrange the components at will. Even with the attraction of mortise-type locks in the ability to simultaneously lock and unlock both a deadbolt and a latch bolt, these locks still offer poor security, and suffer because of high installation and construction cost.

It has also been recognized that locksets providing a panic proof exit capability are highly desirable. This type of lockset retracts both a lock bolt and a latch bolt with a single operation on the inside of a door. U.S. Pat. No. 3,910,613 referenced above is an example of such a panic proof lockset.

U.S. Pat. No. 3,791,180 to William J. Doyle illustrates a different construction for a panic proof lockset in a surface-mounted lockset. This construction uses a gear sector to interconnect deadbolt and latch bolt assemblies. The construction shows separately keyed lock bolts and latch bolts. Doyle does not provide for simultaneous locking and unlocking of both a deadbolt and a latch bolt with but a single operation from either inside or outside of a door.

U.S. Pat. No. 3,390,558 to Torno et al shows a complicated lock having many desirable features. It is panic proof and has a latch bolt and deadbolt that can be simultaneously opened from either inside or outside of a door. This construction, however, does not provide a lockset that has a latch bolt and a deadbolt that simultaneously lock or unlock.

The latch bolt is independently locked with push turn bottom on the face of the inside knob. Turning the outside key retracts the deadbolt and the latch bolt, but the latch bolt remains locked. The control on the knob face has to be manually operated to unlock the latch.

SUMMARY OF THE INVENTION

The present invention provides in its basic form a surface-mounted lockset that has a double locking latch bolt and deadbolt that can be simultaneously locked or unlocked by actuaton of the deadbolt. In a preferred form of the present invention this facility and a panic proof feature of simple construction are provided.

The present invention has a deadbolt assembly and a spring latch bolt assembly to provide the security offered by the lockset. The deadbolt assembly includes means such as a crank rotatably mounted in the case for rotation upon retraction or extension of the deadbolt. The case mounts on the inside of a door. A slide in the case is acted upon by the crank during the locking of the deadbolt to move. The slide engages a latch actuator upon the locking of the deadbolt to lock the latch actuator against rotation. The actuator couples directly to the latch bolt assembly, and when engaged by the slide, prevents the latch bolt assembly from retracting. Means bias the slide out of engagement with the actuator so that when the crank frees the slide, the slide moves out of engagement with the actuator to unlock the latch bolt assembly. This occurs when the deadbolt is unlocked.

In preferred form, the present invention includes a deadbolt assembly that employs a standard tailpiece drive. As such, rotation of the tailpiece drive by the likes of a key-actuated cylinder or thumb piece rotates the tailpiece and extends or retracts the deadbolt, all in a standard fashion. A crank engages the tailpiece drive so that rotation of the tailpiece drive rotates the crank. The crank mounts in a surface mountable case. The crank also rotates from an inside operator, such as another key-actuated cylinder. A detent in the case and associated with the crank determines various positions for the crank. In one position the crank bears on a slide and has moved the slide to engage a latch actuator of a spring latch bolt assembly to keep the latch bolt locked. The slide and actuator are in the case. In an alternate position, the crank is free of the slide and the slide is free of the latch actuator. Preferably, the engaged position corresponds to a left or right position of the crank on either side of the axis of rotation of the tailpiece drive. The detents provide some resistance against movement of the crank. The slide mounts in the case for translation in response to biasing means, such as springs, away from the latch bolt assembly and towards the crank, that is, the slide is biased for engaging the crank and from engaging the actuator. The slide is positioned so that rotation of the crank during the locking of the deadbolt brings a head of the crank to bear on the slide to force the slide against the action of the biasing means into engagement with the actuator. Conveniently, the slide may be mounted to track on longitudinal tracks of the case and may be guided by a strap opposite the tracks. The actuator preferably mounts on a standard spindle assembly of the latch bolt. When the actuator is arrested by the slide, the latch bolt locks. When the deadbolt is retracted, the crank rotates out of engagement with the slide, and the biasing means forces the slide out of engagement with the latch actuator. Locking of the actuator by the slide may be by a tooth of one in a notch of the other. The latch bolt in an unactuated position has its part of this lock lined up with its complement of the slide. Thus the deadbolt and the latch bolt simultaneously lock and unlock in response to the locking and unlocking of the deadbolt.

The preferred form of the present invention provides the simultaneous locking and unlocking feature with a panic proof feature. The preferred form of the present invention includes a retractor mounted in the case. This retractor carries a slide which is biased on the retractor towards a crank of a deadbolt assembly. Both the slide and the crank are in the case and move in translation. The crank, upon locking of the deadbolt, rotates into a position of engagement with the slide and moves the slide on the retractor against the force of the bias into a locking position. This locking position has the slide engaged with a latch actuator, as by a tooth of one in a notch of the other. The latch actuator couples to a latch bolt assembly. The retractor biases towards the latch bolt assembly. An inside operator, such as a doorknob, operates a cam that engages the retractor, preferably such that rotation of the knob in either direction produces translation of the retractor against the bias with such motion of the retractor. With this motion, the slide is carried away from the actuator. With this motion of the slide, the slide rotates the crank of the deadbolt assembly from its locked to its unlocked position. The retractor moves in response to the cam. Thus there is a simultaneous unlocking of the deadbolt and latch bolt by a single turn of the inside operator, and a panic proof feature is effected. Preferably, the actuator is engaged by the retractor such that the actuator is normally positioned to be engaged by the slide for locking. This may be accomplished by followers on the actuator engaged by the retractor so that the actuator rotates under the bias on the retractor into a position where it can be locked by the slide. Upon movement of the retractor in response to the cam, the actuator and the retractor come uncoupled. A dog of the retractor spaced from one of the actuator followers engages such follower after the retractor has moved sufficiently to unlock the slide from the actuator and rotates the latch actuator to retract the latch.

These and other features, aspects and advantages of the present invention will become more apparent from the following description, appended claims and drawings.

DESCRIPTION OF THE PREFERRED EMBODIMENTS

With reference to FIGS. 1 through 4, a simultaneous locking and unlocking, double bolt lockset is illustrated.

Figure 1:
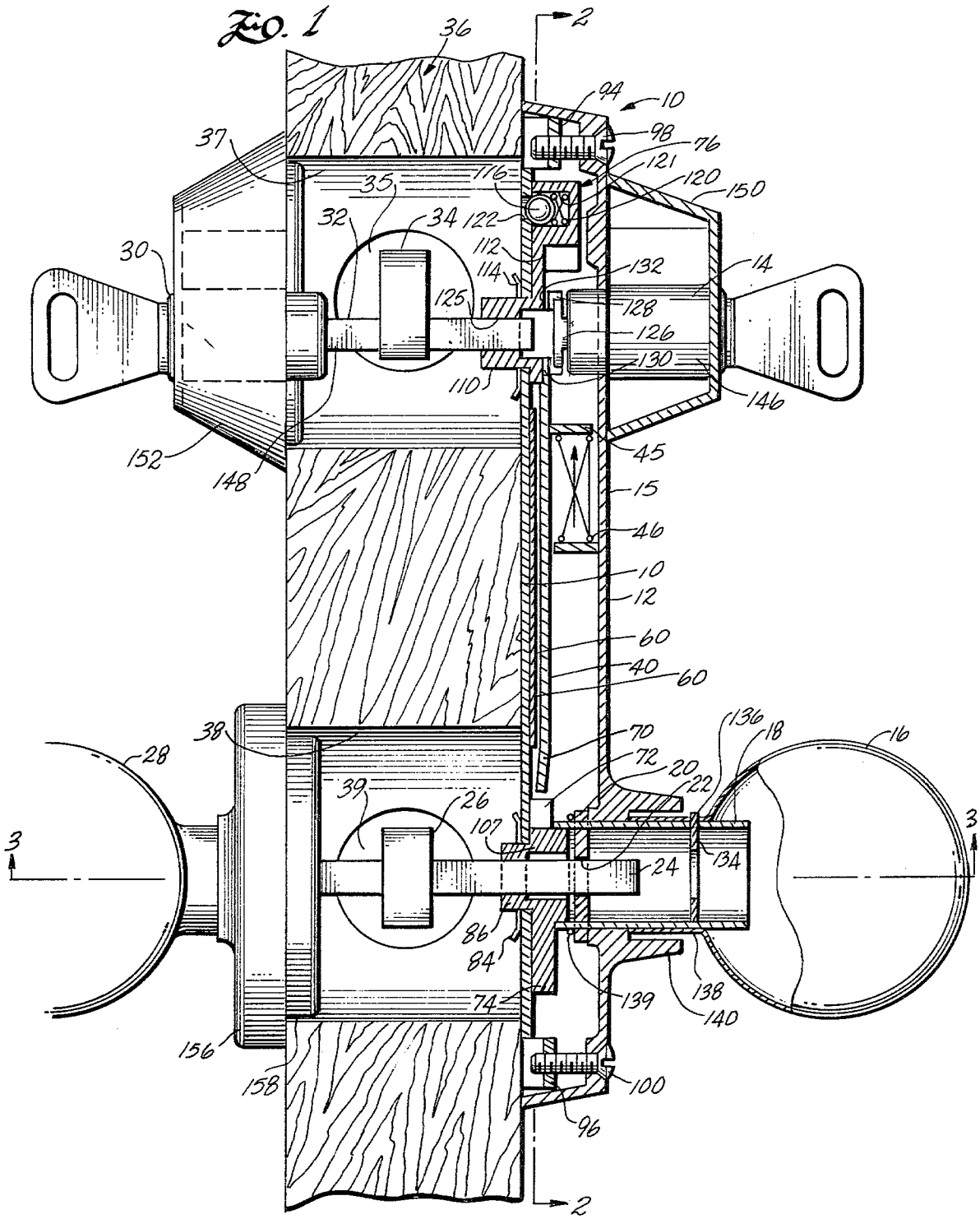
FIG. 1 illustrates in side elevation, mostly in half section, the preferred form of the basic lockset of the present invention.

As seen in FIG. 1, the lock includes a flat base plate 10 covered and enclosed by a case 12. A standard key actuated inside cylinder assembly 14 extends outwardly from an exterior face 15 of case 12 and into a space between case 12 and base plate 10. (Exterior face 15 faces the interior of a room.) An inside hand operator or knob 16 attaches to a barrel 18 to rotate the latter. Barrel 18 has proximate its interior end a retaining disc 20 that has a square hole 22 in receipt of a complementary, square in cross-section spindle 24. The spindle operatably couples to a standard latch bolt assembly 26. Rotation of operator 16 in either direction operates the latch bolt. Latch bolt 26 is also actuatable through an outside hand operator 28 coupled in any convenient fashion to spindle 24 so that rotation in either direction of outside hand operator 28 operates the latch bolt. An outside key actuated cylinder assembly 30 mounts opposite key actuated cylinder assembly 14, and the two share a tailpiece drive 32. Tailpiece drive 32 operates a standard deadbolt assembly 34.

Thus the lock of the present invention includes a deadbolt 34 and a latch bolt 26. The deadbolt is actuatable by either of a pair of key actuated cylinder assemblies. It should be understood that the deadbolt can be actuated by other mechanisms known in the art, for example, inside cylinder 14 may be replaced by a thumb piece assembly. Similarly, the latch bolt is actuated by inside or outside hand operators. The knob shown can give way to other operators; for example, outside operator 28 can be replaced by a standard lever or a thumb piece on a handle set. Key actuated cylinder assembly 14 and inside hand operator 16 both mount in a common assembly, the exterior boundaries of which are constituted of a base plate 10 and case 12.

Base plate 10 and case 12 attach in a standard manner to a door 36 on the inside. Deadbolt assembly 34 is received in a door edge hole 35 and a door cross bore 37. Latch bolt assembly 26 is received in a door cross bore 38 and a door edge hole 39, both in door 36.

The present invention provides facile means for simultaneously locking and unlocking both the deadbolt and latch bolt in a single operation.

To this end, a slide 40 housed within case 12 is capable of reciprocating longitudinally (up and down in FIG. 2) between tailpiece drive 32 and spindle 24. Slide 40 is spring biased upwardly towards tailpiece drive 32 by coil springs 44 (see both FIGS. 1 and 2). The slide 40 has a pair of laterally and inwardly extending ears 45 for bearing by biasing springs 44. The other end of springs 44 bear against tabs 46 that extend inwardly from the bottom face of case 12. As seen best in FIG. 4, springs 44 are confined within a channel defined by longitudinally and inwardly extending walls 48 of slide 40 and opposite walls 50 of the case. Ears 45 and walls 48 can be conveniently formed by lancing from slide 40.

Slide 40 tracks on opposed ways 52 and 54 that run parallel to each other and are formed in case 12. Each of the ways has side and lateral surfaces, typified by surfaces 56 and 58, respectively, for ways 54 (FIG. 4), that confine the slide. Strap 60 spans the width of slide 40 and confines the slide from moving toward base plate 10. Strap 60 attaches to case 12 as by screws 62.

Figure 2:
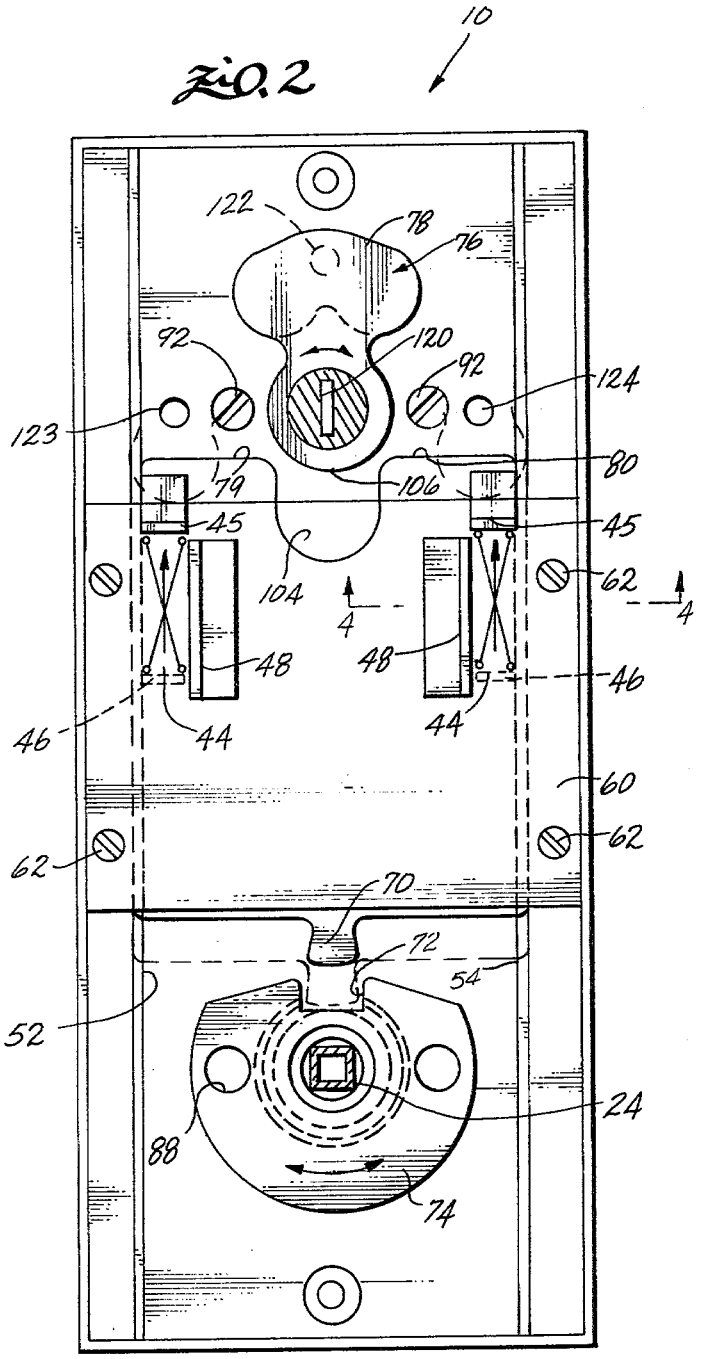
FIG. 2 is a rear elevational view taken generally in the plane of 2—2 in FIG. 1, and it shows in partial phantom alternate positions of a crank of the assembly.

As seen in FIG. 2, slide 40 has a tooth 70 at its bottom end that is adapted to be received in a notch 72 of an actuator 74. The actuator is keyed for rotation with spindle 24. Thus when tooth 70 resides in notch 72, actuator 74 cannot rotate. Latch bolt assembly 26 cannot then be withdrawn.

As will now be developed, tooth 70 resides in notch 72 when deadbolt assembly 34 is in its extended position. When the deadbolt is retracted, springs 44 force the slide upwardly and tooth 70 out of notch 72, freeing the actuator. The latch bolt and deadbolt simultaneously lock and unlock.

Tailpiece 32 drives a crank 76. Crank 76 has a head 78. Head 78 can engage either of upper surfaces 79 or 80 of slide 40 to force the slide downwardly and tooth 70 into notch 72. These positions of head 78 are shown in the phantom depiction in FIG. 2.

Actuator 74 keys to spindle 24 to rotate with the latter. A keeper 84 frictionally engages a hub 86 of actuator 74 to hold the actuator to base plate 10.

Figure 3:
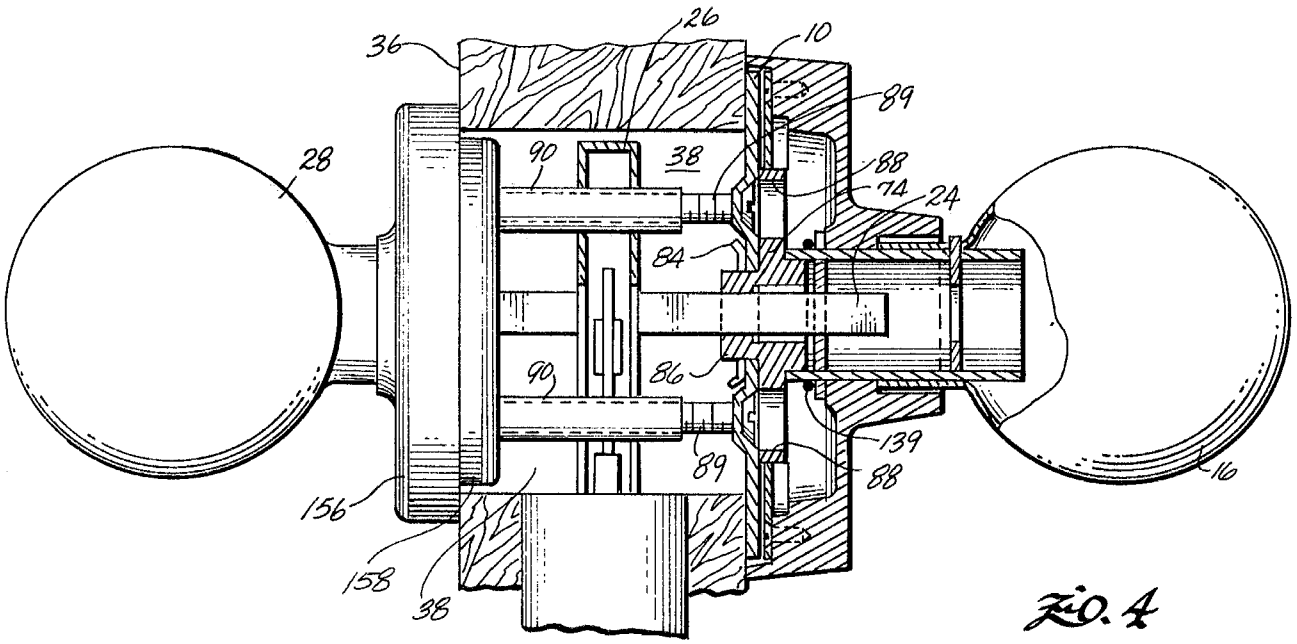
FIG. 3 views in cross section and in end elevation, in the plane of 3—3 of FIG. 1 the latch bolt assembly, attendant operators, and the case of the present invention.

As seen in FIG. 3, a pair of diametrically opposed holes 88 in actuator 74 permit access to screws 89 that retain outside hand operator 28 and rotationally constrain latch bolt assembly 26. Screws 89 have heads that bear in countersunk recesses in base plate 10 and thread into bosses 90 of outside operator 28. As is known, latch bolt assembly 26 includes a frame 91 that passes bosses 90 and the latter keep the latch bolt assembly from rotating. As is also known, latch bolt assembly 26 can be changed so that it is suitable for either left- or right-hand doors by merely removing the constraining screws and rotating the latch bolt assembly so that the latch bolt extends from the proper edge of a particular door. A similar and standard provision obtains for the deadbolt assembly 34 where screws 92 constrain the deadbolt assembly from rotation and retain outside cylinder 30. Screws 92 can be removed so that the dead bolt can be rotated between 180 degree positions for left-hand or right-hand door.

Mounting plate 10 has screw-receiving bosses 94 and 96 to receive screws 98 and 100, the heads of which bear in countersunk recesses in case 12. These screws hold the case to base plate 10.

What has been described thus far is a simultaneously locking and unlocking double bolt lock, the fundamental components of which are all encased in case 12. The assembly includes reciprocable slide 40 biased by springs 44 in a direction away from locking engagement with actuator 74. Locking engagement is effected upon the extension of deadbolt 34 by the concomitant rotation of crank 76 into bearing with slide 40 and the overcoming of the opposing forces of springs 44. This produces movement of slide 40 so that tooth 70 passes into notch 72, locking the latch bolt assembly 26. Unlocking is effected merely by withdrawing the deadbolt of assembly 34, which produces a resulting turning of crank 76 out of engagement with one of the upper surfaces 79 and 80 of slide 40 and into an unlocked position. Springs 44 then push slide 40 away from actuator 74.

Details of the construction of the first four Figures will now be presented. Slide 40 includes a notch 104 to clear a hub 106 of crank 76. Tooth 70 may be bent slightly toward base plate 10 for good registration with notch 72.

Actuator 74 has a body 107 from which hub 86 projects through a cooperating hole in base plate 10. The body bears on one side of the base plate and keeper 84 bears on the other side to keep actuator 74 mounted to the base plate.

A similar arrangement obtains for crank 76. Crank 76 has a hub 110 that extends through a cooperating hole in base plate 10. The crank has a body 112 that bears on the inside surface of base plate 10. A keeper 114 frictionally engages hub 110 and keeps the crank attached to the base plate.

A detent ball 116 mounted in head 78 of crank 76 is spring biased toward base plate 10 by a spring 120. Ball 116 and spring 120 are in a dead end bore 121 in head 78. Base plate 10 has three detent holes 122, 123, and 124 that can receive ball 116. (Hole 122 is seen in FIG. 1, and holes 123 and 124 are seen in FIG. 2.) Detent ball 116 drops into hole 122 when the crank is in a position corresponding to a retracted deadbolt. This gives a positive indication to an operator of retraction. When the detent ball is in either hole 123 or hole 124, the crank is in a position corresponding to an extended deadbolt and a locked latch bolt.

As was previously mentioned, tailpiece 32 is capable of rotating crank 76. Tailpiece 32 slips into a rectangular slot 125 of hub 110 of crank 76. Rotation of the crank also results from actuation of cylinder assembly 14. Cylinder 14 also has a T-shaped tailpiece drive indicated at 126. This drive includes lugs 128 that extend radially of the axis of rotation of the drive and are received in slots 130 of an interior boss 132 of body 112. Boss 132 extends away from the plane of the body 112 towards cylinder assembly 14.

The mounting of the hand operators is standard. Briefly with reference to FIG. 1, hand operator 16 has a cylindrical extension 138 received on barrel 18. A knob retainer ring 134 has a radially extending retaining tooth 136 that passes through a cooperating slot in barrel 18 and cylindrical extension 138 of operator 16. The interior end of barrel 18 is castellated and retaining disc 20 has lugs extending through resulting slots in the cylinder to couple disc 20 to the barrel. As will be recalled, square hole 22 is in driving engagement with spindle 24. A wire clip retainer 139 snaps over the interior end of barrel 18 to keep disc 20 on the barrel and in an axially proper position.

Case 12 has a hub 140 that receives cylindrical extension 138 of inside hand operator 16 and passes barrel 18.

Figure 4:
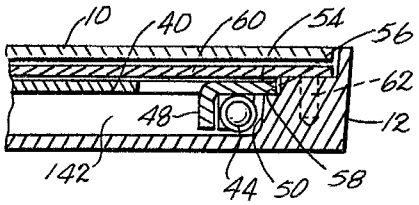
FIG. 4 is a partial cross sectional view in end elevation taken in the plane 4—4 of FIG. 2.

With reference to FIG. 4 and FIG. 1, it can be seen that case 12 has an interior trough 142 that receives slide 40 and coil springs 44, as well as strap 60.

Key actuator cylinder assembly 14 includes a cylinder proper 146. This cylinder is held in place in a standard fashion. Tailpiece drive 126 extends from the cylinder. Cylinder assembly 30 has a cylinder proper 148 from which tailpiece drive 32 extends. Both cylinders have approximately 180 degree lost motions. Cylinder assembly 14 has a housing 150, and cylinder assembly 30 has a housing 152. These housings tie together across door 36 with fasteners in the manner of inside and outside operators 16 and 28. Outside operator 28 has an escutcheon 156 bridging door cross bore 38. It also has a base 158 in the door cross bore 38 from which bosses 90 extend.

When crank 76 and tailpiece drive 32 are positioned as shown in FIG. 2, with the lost motion divided approximately 90 degrees clockwise and 90 degrees counter-clockwise, and deadbolt assembly 34 in a retracted or unlocked position at assembly, the lock can be installed in left-or right-handed doors without special handling.

Figure 5:
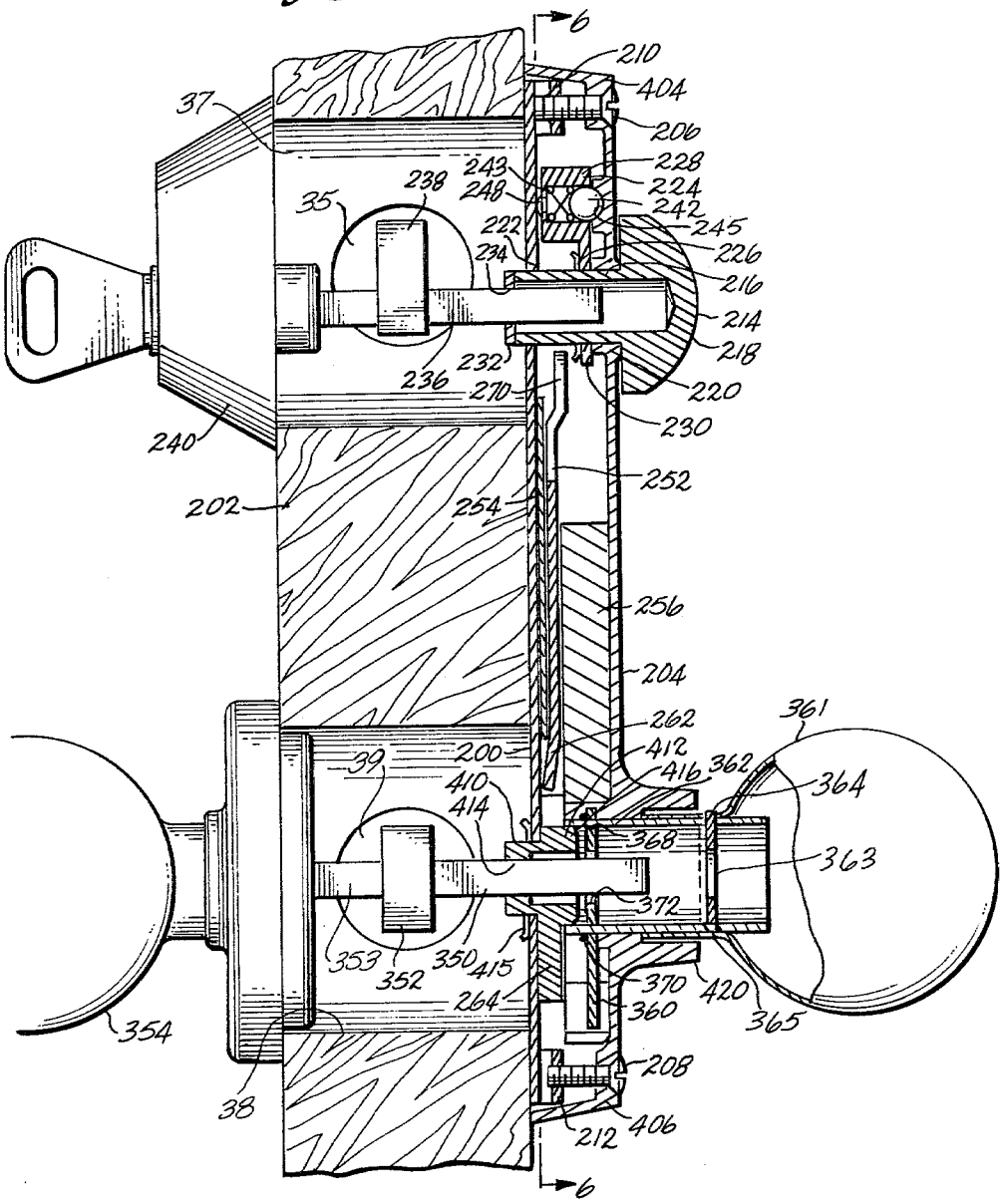
FIG. 5 is a side elevation view, mostly in half section, of the preferred form of the lockset of the present invention that employs the panic proof feature.
Figure 6:
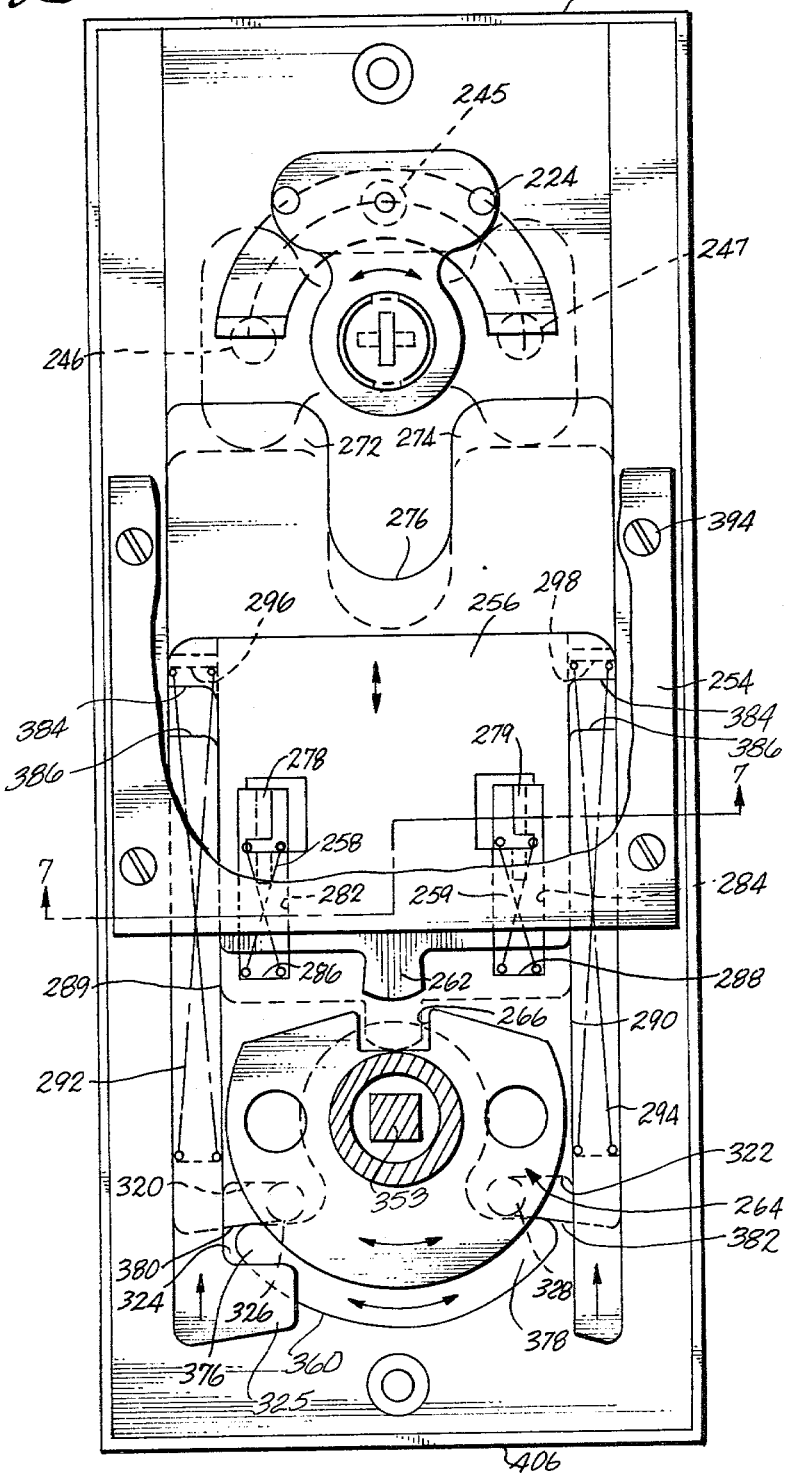
FIG. 6 is a view taken in the plane 6—6, partly fragmented, showing alternate positions of various mechanisms in phantom.
Figure 7:
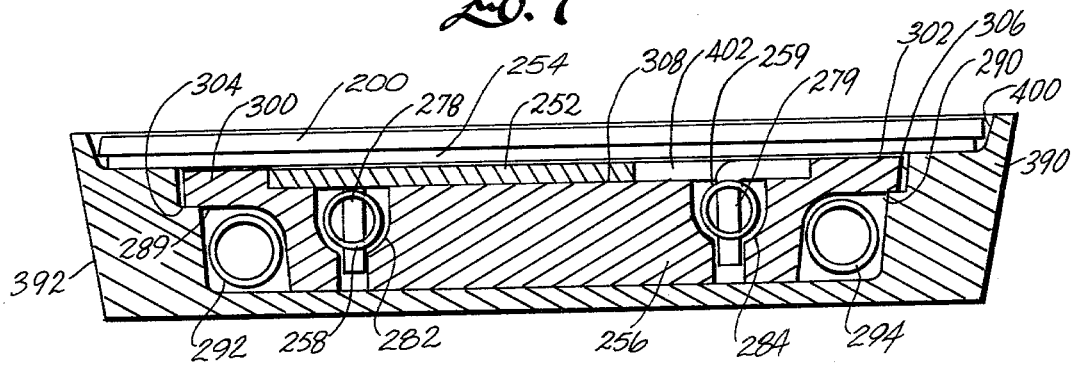
FIG. 7 is a cross sectional view in end elevation taken in the plane 7—7 of FIG. 6.

With reference to FIGS. 5 through 7, the preferred embodiment of the present invention will be described. This embodiment provides a panic proof feature: when a double acting lockset is locked and an inside hand operator actuated, a latch bolt and a deadbolt both retract simultaneously.

This embodiment has many similarities with the version of the double acting lockset just described. The double acting lockset of this version includes a flat base plate 200 adapted to lie against a door 202. A case 204 attaches to base plate 200 as through threaded fasteners 206 and 208. The case encloses the plate. The fasteners, in the form of screws, have heads that bear in complementary countersunk recesses in the case, and shanks that thread into mounting lugs 210 and 212 of the base plate, respectively.

A thumb piece actuator 214 has a shank 216 extending from a head 218 through a boss 220 of the case and through a hole 222 in the base plate.

A locking crank 224 secures a shank 216 and axially relates to the shank through retainer ring 226 which is frictionally secured to shank 216. As before, crank 224 has a head 228 and a hub 230. It is the hub that is in direct engagement with shank 216 of thumb piece 214. Hub 230 also bears on the interior end of boss 220 and is directly engaged by ring 226. A driving disc 232, secured at the interior end of shank 216, has a rectangular slot 234 in receipt of a tailpiece drive 236. This tailpiece drive engages a deadbolt 238 in a known fashion to extend and withdraw that deadbolt depending on the rotation of the tailpiece drive. The same tailpiece drive is drive-coupled to a standard key and cylinder 240 in a known manner. This standard key and cylinder mounts on the outside of door 202.

Crank 224 again has a detent ball 242 to locate the crank in its neutral position. The detent ball is spring-biased by a spring 243 and both the ball and spring are in a dead end bore 244. Detent ball 242 engages a recess 245 in the case in a neutral position. Two other recesses 246 and 247 in the case can provide stops for the crank in locked positions. These recesses are about 90 degrees from recess 245 and 180 degrees from each other. A tracking button 248 on the crank bears on an interior surface of base plate 200.

Thus, actuation of key and cylinder 240 or thumb piece actuator 214 extends or withdraws deadbolt 238 in a standard fashion. A crank 224 carried by the thumb piece rotates with the thumb piece whether the thumb piece itself is being rotated by direct actuation or whether the thumb piece is being rotated through tailpiece drive 236 from a key in cylinder 240.

A generally flat slide 252 mounts within case 204 for translation towards and away from tailpiece drive 236. The slide is bracketed between a strap 254 attached to case 204 and a retractor 256. Slide 252 couples to retractor 256 by a pair of complementary springs 258 and 259 acting between the retractor and the slide to bias the slide towards the tailpiece drive. As before, the slide has a cog or tooth 262 for locking a latch actuator 264 by receipt in a notch or slot 266 in that actuator.

Thus, as the crank 224 is rotated in either direction it engages the upper end of slide 252 and moves that slide downwardly to tend to insert tooth 262 into notch 266 and prevent rotation of latch actuator 264.

The relationship between retractor 256 and slide 252 will be described in somewhat greater detail now, together with the specific geometry of each. Slide 252 is a generally flat piece that steps up away from base plate 200 at 270 to present to crank 224 a pair of follower ears 272 and 274. A space 276 between the ears accommodates shank 216. The slide is struck out at 278 and 279 to form spring bearing bosses against which springs 258 and 259 bear.

Retractor 256 has a pair of pockets 282 and 284 for receiving springs 258 and 259, respectively. An end 286 and 288 of each of these pockets forms the bearing surface for springs 258 and 259, respectively. Retractor 256 has a pair of lateral recesses 289 and 290 that receive springs 292 and 294. These springs bear at their upper ends against bosses 296 and 298 of the case. The springs bear at their lower ends on the terminal surfaces of slots 289 and 290 of the retractor. The retractor is thus biased downwardly towards latch actuator 264. The retractor only moves against the force of springs 292 and 294.

As can be seen in FIG. 7, retractor 256 has a pair of opposed sides 300 and 302 that track on cooperating rails 304 and 306 formed in the case.

With reference again to FIGS. 5, 6 and 7, retractor 256 is also recessed at 308 to receive slide 252. Retractor 256 includes at its bottom end a pair of bearing surfaces 320 and 322. Surface 320 forms one wall of a notch that also has a bearing surface 324 opposite surface 320. Surface 324 is on a dog 325.

Actuator 264 has a pair of depending follower pins or lugs 326 and 238 for bearing on surfaces 320 and 322, respectively. Follower pins or lugs serve among other things, as stops positioning the retractor in its closest position to the latch bolt assembly. By having the pins on either side of the axis of rotation of the latch bolt assembly, the pins perform their stop function and can locate the actuator in its unique position with notch 266 facing tooth 262. The actuator pins or lugs react against the force of springs 292 and 294 to produce a balanced couple on the actuator so that the actuator does not rotate and the retractor cannot move closer to the latch bolt assembly. A latch actuator 264 mounts on a spindle drive 350 that operates a latch bolt 352 in a standard fashion. The spindle drive includes a square in cross section spindle proper 353. An outside hand operator 354 engages spindle drive 350 to extend or retract the latch bolt. Simultaneously with this extension the actuator rotates with the spindle, and through one or the other of pins 326 and 328 bearing the associated one of surfaces 320 and 322 forces retractor 256 away from the axis of the spindle drive towards the tailpiece drive. The spring forces of springs 292 and 294 on the pins tend to center the actuator. When tooth 262 is at home in notch 266, actuator 264 cannot rotate, pins 326 and 328 being prevented from acting by the tooth.

A retractor cam 360 secures to an inside hand operator 361 for rotation with it. A castellated barrel 362 attaches to inside hand operator 361 by a retainer ring 363 within the barrel and a retaining tooth 364 extending through a slot in a cylindrical extension 365 of hand operator 361. The fingers of the castellated barrel pass through slots 368 of the cam.

A spring clip 370 keeps the retractor cam axially located with respect to barrel 362 against circumferential flats at the base of the castellations of the barrel. Rotation of hand operator 361 rotates the cam 360. Cam 360 has a hole 372 through it. This hole passes spindle 353. The cam is not directly coupled to the spindle.

As seen in FIG. 6, the cam has two camming ears 376 and 378 that are capable of bearing on follower bosses 380 and 382, respectively, of retractor 256 to push that retractor upwardly towards tailpiece drive 236. As seen in FIG. 6, slide 252 has shoulders 384 and retractor 256 has shoulders 386. The shoulders of the slide and retractor engage in the locked position of these two elements. With unlocking movement of the retractor, the slide is positively moved through this shoulder engagement against the resisting force of the detent. With travel of the retractor in response to cam 360, slide 254 travels and tooth 262 clears notch 266. After the tooth clears the notch, bearing surface 324 of boss 325 of the retractor engages pin 326 and rotates the actuator to withdraw the latch bolt. Thus the space between bearing surfaces 320 and 324 constitutes a lost motion space to permit travel of retractor 256 in response to retractor cam 360 to draw tooth 262 out of slot 266 and permit rotation of actuator 264.

With upward travel of slide 252, one of the ears 272 and 274 of the slide engages crank 228 and rotates the crank in a sense to retract the deadbolt and to position the crank in a central, unactuated position, shown in solid lines in FIG. 6. Thus there is a simultaneous opening of the deadbolt and latch bolt in response to turning of inside hand operator 361. There is also simultaneous locking of the deadbolt and the latch bolt due to the relationship between the slide and the crank operated off the deadbolt drive.

When the lockset is unlocked, rotation of inside operator 361 again rotates cam 360 to translate retractor 256. Dog 325 picks up pin 326 of actuator 264 and the actuator rotates, rotating spindle 353 to unlatch the latch bolt. Whether the lockset is locked or unlocked, retractor 256 moves in response to rotation of cam 360.

Obviously changing the operators has no bearing on the functioning of the present invention. Thus outside hand operator 354 need not be in the form of a knob, but can be a lever or thumb piece.

As seen in FIG. 6, springs 292 and 294 bias retractor 256 towards spindle drive 350, that is, towards the bottom in FIGS. 5 and 6. Springs 258 and 259 bias slide 252 away from spindle drive 350 towards tailpiece drive 236 in these Figures. Thus, to keep slide 252 in its locked position with tooth 262 in notch 266, crank 224 must bear against either of ears 272 or 274 of the slide. The detent ball 242 in either or recesses 246 or 247 tends to keep the crank against the slide and helps to oppose the force of springs 258 and 259 that tends to position the crank in its neutral position.

As seen in FIGS. 5 and 6, slide 252 is constrained to move in its plane by retractor 256 on one side and strap 254 on the other. Strap 254 is attached to sides 390 and 392 of case 204 by headed male fasteners 394. Base plate 200 sandwiches strap 254 and, as previously mentioned, is attached to case 204 through fasteners 208 and 206.

The longitudinal extent of strap 254 is limited by the position of tailpiece drive 236 and spindle drive 350.

Rails 304 and 306 on which retractor 256 tracks are defined by an "L" in cross section shaped track in each instance, with the base of the track being parallel to the base plate and a side of the track being generally normal to the base plate to provide lateral constraint for the retractor.

The case defines a first trough 400 of major area that accepts and contains base plate 200 and strap 254. A second trough 402 opens into trough 400. The second trough is of less lateral extent than trough 400, but of greater depth. The second trough houses and contains retractor 256 and slide 252, as well as the attendant biasing springs.

Case 204 has at its top and bottom lateral walls 404 and 406 that complete the enclosure defined by the case.

As can be seen in FIG. 5, latch actuator 264 has a hub 410 that extends inwardly from a body 412. A square in cross section hole 414 in hub 410 receives spindle 350 so that the spindle can rotate the hub. A keeper 415 frictionally engages the outer surface of hub 410 and bears against a wall of base plate 200. Body 412 on the other side of the base plate from keeper 415 bears on the base plate. Thus the keeper and the body keep the retractor oriented with respect to the base plate. Pins 326 and 328 extend outwardly with respect to base plate 200 from retractor 264 for their receipt in the notches of retractor 256. Retractor 264 includes a second hub 416 that extends outwardly and away from base plate 200. Barrel 362 receives over the outside of this hub so that it is maintained concentric with the axis of the spindle. As in the previously described embodiment, case 204 has a hub 420 that extends outwardly away from it and which receives a cylindrical section of operator 361.

Accordingly, the present invention provides in a surface mounted lockset simultaneous locking and unlocking of two bolts by the locking or unlocking of one of those bolts. The present inventon provides for such a facility in a lockset that mounts on a door and is not of the mortise type. Accordingly, the present invention provides a lockset that has all the security attendant with locksets not of the mortise type. The facility for simultaneous locking and unlocking is accomplished with an economy of parts and in a simple and reliable fashion. A deadbolt controls a crank that in turn moves its slide. The slide locks an actuator of the second bolt to prevent its rotation. The slide is spring-biased towards an unlocked position. All of the mechanisms to accomplish this are located in a surfce mounted case. When unlocking is desired the deadbolt is retracted and that frees the slide from the constraints of the crank. The springs move the slide out of locking engagement with the actuator and frees the second bolt.

In a preferred embodiment of the present invention this simultaneous locking and unlocking is also accompanied by a panic proof feature that permits the unlocking of the lockset by a single twist of an inside hand operator. This version of the present invention employs a retractor coupled to the slide by biasing springs that urge the slide out of locking engagement with an actuator. The retractor is capable of longitudinal movement and is spring-biased towards the actuator. The turning of the inside hand operator effects translation of the retractor independent of the actuator to permit the movement of the slide out of locking engagement with the actuator and movement of the crank by the slide to an unlocked position.

The present invention has been described with reference to certain preferred embodiments. The spirit and scope of the appended claims, however, should not necessarily be limited to the foregoing description.

What is claimed is:

1. An improvement in an integrated, two-bolt lockset of the type that mounts on the surface of a door comprising:

(a) a case;

(b) means for mounting the case to the inside of a door;

(c) a deadbolt assembly including an outside operator adapted for mounting on the outside of the door and an inside operator mounted on the case, the deadbolt assembly including a deadbolt and a deadbolt drive responsive to either of the deadbolt operators to rotate between a locked and an unlocked position, the deadbolt drive including crank means;

(d) a latch bolt assembly including an outside operator adapted for mounting on the outside of the door and an inside operator mounted on the case, the latch bolt assembly including a latch bolt and a latch bolt drive responsive to either of the latch bolt operators to rotate between a latch bolt open and a latch bolt closed position;

(e) a slide mounted in the case for translation between a locked position proximate the latch bolt assembly and an unlocked position proximate the deadbolt assembly;

(f) biasing means to bias the slide away from the latch bolt assembly;

(g) an actuator on the latch bolt drive;

(h) means of the slide and the actuator to lock the actuator and lock the latch bolt assembly in a locked position of the slide; and (i) the crank means of the deadbolt drive being rotatable between a locked and an unlocked position and operable during rotation between its unlocked and locked positions to engage the slide in its unlocked position and to translate the slide against the force of the biasing means into the locked position of the slide upon the locking actuation of either of the deadbolt operators, the crank means rotating with either of the deadbolt operators to disengage the slide and thereby unlock the actuator upon rotation of either of the deadbolt operators into an unlocked position.

2. The improvement claimed in claim 1 including detent means acting on the crank means in the locked and unlocked positions thereof to apply a force thereto that tends to maintain the crank means in such positions.

3. The improvement claimed in claim 2 wherein the case mounting means includes a base plate, the base plate having means to secure it to the door and the case having means to secure it to the base plate.

4. The improvement claimed in claim 3 wherein the actuator and the slide have a tooth and a notch which upon engagement of the tooth in the notch provides the locking of the actuator.

5. The improvement claimed in claim 4 wherein the actuator includes a hub rotatably mounted on the base plate.

6. The improvement claimed in claim 5 wherein the deadbolt drive includes tailpiece drives and the latch bolt drive includes a spindle drive.

7. The improvement claimed in claim 3 including track means in the case for the slide, the slide bearing and tracking on such track means.

8. The improvement claimed in claim 7 wherein the crank means is engageable with the slide means on upper ends thereof to force the slide means into its locked position.

9. The improvement claimed in claim 7 including strap means attached to the case and constraining the slide on the opposite side of the track means.

10. The improvement claimed in claim 9 wherein the biasing means for the slide includes spring means between the slide and the case, ears struck from the slide providing bearing for one end of the spring means and tabs of the case providing bearing for the other end of the spring means.

11. The improvement claimed in claim 9 wherein the case has a trough with longitudinal walls, the slide has longitudinal inwardly directed walls paralleling the case wall, and the spring means is confined between the case walls and the inwardly directed walls.

12. The improvement claimed in claim 3 wherein the deadbolt assembly and the latch bolt assembly each are reversible so that the improvement can be installed in either left- or right-handed doors.

13. In a double bolt lockset of the type that mounts on the surface of the door and which includes a deadbolt assembly and a latch bolt assembly, the deadbolt assembly including inside and outside operators to extend and retract the deadbolt through a deadbolt drive upon locking and unlocking the deadbolt operator, the latch bolt assembly having inside and outside operators to extend and retract the latch bolt through a latch bolt drive upon operation of either of such operators, and a case mounting the inside operators of both the latch bolt and deadbolt and having means to mount the case to a door, an improvement which comprises:

(a) a slide mounted in the case for translation towards and away from the deadbolt assembly and the latch bolt assembly;

(b) means to bias the slide away from the latch bolt assembly towards the deadbolt assembly;

(c) crank means coupled to the deadbolt assembly for rotation between a locked position in engagement with the slide and an unlocked position out of engagement with the slide, such positions corresponding to a locked deadbolt and an unlocked deadbolt;

(d) a latch actuator rigidly secured to the latch bolt drive and located in the case in line with the slide;

(e) means for the slide and the latch actuator to lock the latch actuator against rotation upon engagement by the slide in response to movement of the crank means to the locked position, the biasing means between the slide and the case moving the slide out of locking engagement with the actuator upon movement of the crank means to its unlocked position;

whereby, upon locking of the deadbolt the crank means engages the slide and translates the slide into locking engagement with the latch actuator and upon unlocking the deadbolt the crank means releases the slide to the biasing means and the slide unlocks from the latch actuator, and simultaneous locking and unlocking of the deadbolt and latch bolt occur.

14. The improvement claimed in claim 13 wherein the latch bolt assembly is of the type that biases the latch bolt into an extended position and the latch bolt drive operates in rotation, the actuator has a unique rotational position when the latch bolt is extended, and the lock means for the latch actuator and slide include a tooth and a notch which upon engagement of the tooth in the notch locks the actuator.

15. The improvement claimed in claim 14 including detent means acting on the crank means in the locked and unlocked positions thereof to apply a force thereto that tends to maintain the crank means in such positions.

16. The improvement claimed in claim 15 wherein the case mounting means includes a base plate, the base plate having means to secure it to the door and the case having means to secure it to the base plate.

17. The improvement claimed in claim 16 wherein the deadbolt drive includes a tailpiece drive and the latch bolt drive includes a spindle drive.

18. The improvement claimed in claim 16 including track means in the case for the slide, the slide bearing and tracking on such track means, and strap means attached to the case and constraining the slide on the opposite side of the track means.

19. In a double bolt lockset of the type that mounts on the surface of the door and which includes a deadbolt assembly and a latch bolt assembly, the deadbolt assembly including inside and outside operators to extend and retract the deadbolt through a deadbolt drive upon locking and unlocking the deadbolt operator, the latch bolt assembly having inside and outside operators to extend and retract the latch bolt through a latch bolt drive upon operation of either of such operators, and a case mounting the inside operators of both the latch bolt and deadbolt and having means to mount the case to a door, an improvement which comprises:

(a) a retractor mounted in the case for translation towards and away from the deadbolt assembly and the latch bolt assembly between a locked position proximate the latch bolt assembly and an unlocked position proximate the deadbolt assembly;

(b) a slide mounted on the retractor and in the case for translation towards and away from the deadbolt assembly and the latch bolt assembly; p1 (c) means to bias the slide away from the latch bolt assembly towards the deadbolt assembly;

(d) means to bias the retractor toward the latch bolt assembly;

(e) crank means coupled to the deadbolt assembly for rotation between a locked position in engagement with the slide and an unlocked position out of engagement with the slide, such positions corresponding to a locked deadbolt and an unlocked deadbolt, the crank means in rotating between the unlocked position and the locked position engaging the slide and translating the retractor and slide to the retractor's locked position;

(f) a latch actuator secured to the latch bolt drive and located in the case in line with the slide;

(g) means for the slide and the latch actuator to lock the latch actuator against rotation upon engagement by the slide in response to movement of the retractor to its locked position in response to movement of the crank means to its locked position; and (h) means coupled to the inside operator of the latch bolt assembly for moving the retractor against the force of its biasing means from its locked position and moving the crank means through the slide to its unlocked position upon operation of such operator;

whereby: (i) upon locking of the deadbolt, the crank means engages the slide and translates the slide and retractor to lock the slide with the latch actuator; (ii) upon unlocking the deadbolt the crank means releases the slide to the slide biasing means and the slide unlocks from the latch actuator; and simultaneous locking and unlocking of the deadbolt and latch bolt occur; and (iii) upon operation of the inside operator of the latch bolt assembly, when locked, both the latch bolt and deadbolt retract to open positions.

20. The improvement claimed in claim 19 wherein the latch bolt assembly is of the type that biases the latch bolt into an extended position and the latch bolt drive operates in rotation and has a rotational axis, the actuator has a unique rotational position when the latch bolt is extended, and the lock means for the latch actuator and slide include a tooth and a notch which upon engagement of the tooth in the notch locks the actuator.

21. The improvement claimed in claim 20 wherein the means coupled to the inside operator of the latch bolt assembly for moving the retractor includes a cam attached to such operator and operable on the retractor to move the retractor.

22. The improvement claimed in claim 21 including means coupling the retractor to the actuator to produce retraction of the latch bolt after a predetermined amount of travel of the retractor corresponding to disengagement of the tooth and the notch.

23. The improvement claimed in claim 20 wherein the means coupled to the inside operator of the latch bolt assembly for moving the retractor includes a double headed cam with one head on each side of the rotational axis of the latch bolt drive, and follower surfaces on the retractor engageable by each head of the cam to move the retractor, and means coupling the retractor to the actuator to produce retraction of the latch bolt after a predetermined amount of travel of the retractor corresponding to disengagement of the tooth and the notch.

24. The improvement claimed in claim 23 wherein the latch bolt retraction means includes follower means of the actuator spaced from the rotational axis of the actuator and a dog on the retractor engageable with the actuator follower means.

25. The improvement claimed in claim 24 wherein the actuator follower means engages a surface of the retractor spaced from the dog to bias the retractor towards its unique position and including second actuator follower means on the side of the rotational axis opposite the first mentioned follower means and engageable with a second retractor surface to produce a couple opposite a couple produced by the engagement of the first mentioned follower and the retractor surface it engages and to determine the most proximate position of the retractor to the latch bolt assembly.

26. The improvement claimed in claim 25 including detent means acting on the crank means in the locked and unlocked positions thereof to apply a force thereto that tends to maintain the crank means in such positions.

27. The improvement claimed in claim 26 wherein the case mounting means includes a base plate, the base plate having means to secure it to the door, and the case having means to secure it to the base plate.

28. The improvement claimed in claim 27 including track means in the case for the slide, the slide bearing and tracking on such track means and strap means attached to the case and constraining the slide on the opposite side of the track means.

29. The improvement claimed in claim 24 wherein the slide and the retractor have cooperating shoulders engage in the locked position of the retractor such that upon movement of the retractor towards its unlocked position the slide moves with the retractor because of the engagement of the shoulders.

30. The improvement claimed in claim 29 wherein the deadbolt assembly and the latch bolt assembly each are reversible so that the improvement can be installed in either left- or right-handed doors.

* * * * *

UNITED STATES PATENT AND TRADEMARK OFFICE

CERTIFICATE OF CORRECTION

PATENT NO. : 4,276,760

DATED : July 7, 1981

INVENTOR(S) : Roger J. Nolin

It is certified that error appears in the above—identified patent and that said Letters Patent is hereby corrected as shown below:

In the specification: Column 5, line 18, before "tabs" insert --bearing--; Column 7, line 50, delete "a"; Column 10, line 5, "or" should be --of--.

In the claims: Claim 19, column 13, line 55, delete "pl".

Signed and Sealed this

*Twenty-second* Day of *September 1981*

[SEAL]

*Attest:*

GERALD J. MOSSINGHOFF

*Attesting Officer*

*Commissioner of Patents and Trademarks*